US007807035B2

(12) United States Patent
Hillebrand

(10) Patent No.: US 7,807,035 B2
(45) **Date of Patent: *Oct. 5, 2010**

(54) METHODS OF PLATING ZINC-CONTAINING COATINGS UNDER ALKALINE CONDITIONS

(75) Inventor: Ernst-Walter Hillebrand, Wickede (DE)

(73) Assignee: EWH Industrieanlagen GmbH & Co. KG (DE)

( * ) Notice: Subject to any disclaimer, the term of this patent is extended or adjusted under 35 U.S.C. 154(b) by 226 days.

This patent is subject to a terminal disclaimer.

(21) Appl. No.: 12/030,750

(22) Filed: Feb. 13, 2008

(65) Prior Publication Data

US 2008/0164150 A1 Jul. 10, 2008

Related U.S. Application Data

(60) Continuation of application No. 10/618,352, filed on Jul. 11, 2003, now abandoned, which is a division of application No. 09/744,706, filed as application No. PCT/EP99/05443 on Jul. 29, 1999, now Pat. No. 6,602,394.

(30) Foreign Application Priority Data

Jul. 30, 1998 (DE) ..... 198 34 353

(51) Int. Cl.
*C25D 3/56* (2006.01)

(52) U.S. Cl. ..... 205/246

(58) Field of Classification Search ..... 205/246
See application file for complete search history.

(56) References Cited

U.S. PATENT DOCUMENTS

| | | | | |
|---|---|---|---|---|
| 3,660,170 A | | 5/1972 | Rampel | |
| 3,718,549 A | | 2/1973 | Du Rose et al. | |
| 4,192,908 A | | 3/1980 | Himy et al. | |
| 4,469,564 A | | 9/1984 | Okinaka et al. | |
| 4,832,812 A | | 5/1989 | Brown | |
| 4,889,602 A | | 12/1989 | Oshima et al. | |
| 5,162,079 A | | 11/1992 | Brown | |
| 5,310,465 A | | 5/1994 | Vaughan | |
| 5,403,460 A | | 4/1995 | Sala et al. | |
| 5,405,523 A | | 4/1995 | Eckles | |
| 5,417,840 A | * | 5/1995 | Block et al. | 205/246 |
| 5,883,762 A | | 3/1999 | Calhoun et al. | |
| 6,602,394 B1 | | 8/2003 | Hillebrand | |

FOREIGN PATENT DOCUMENTS

| | | |
|---|---|---|
| DE | 925 264 | 3/1955 |
| DE | 33 10 730 A1 | 3/1984 |
| DE | 40 35 316 C2 | 5/1992 |

(Continued)

OTHER PUBLICATIONS

Von Andreas Zahl, Sulingen, Quo vadis Galvanotechnik, Mar. 4, 1998.

(Continued)

*Primary Examiner*—Kishor Mayekar
(74) *Attorney, Agent, or Firm*—Cook Alex Ltd.

(57) ABSTRACT

The anode is separated from the alkaline electrode to avoid undesirable secondary reactions in an alkali zinc nickel electroplating bath.

7 Claims, 1 Drawing Sheet

FOREIGN PATENT DOCUMENTS

| | | | |
|---|---|---|---|
| DE | 3712511 | C3 | 6/1995 |
| EP | 0410919 | A1 | 1/1991 |
| EP | 0 483 937 | A1 | 10/1991 |
| GB | 1349735 | | 4/1974 |
| GB | 1602 404 | | 11/1981 |
| JP | 58093886 | A | 6/1983 |
| JP | 58093899 | | 6/1983 |
| JP | 59193295 | | 11/1984 |
| JP | 04-009493 | | 1/1992 |
| JP | 4017693 | | 1/1992 |
| JP | 04-052296 | | 2/1992 |
| JP | 04-44374 | | 4/1992 |
| JP | 4176893 | | 6/1992 |
| JP | 04-259393 | | 9/1992 |
| JP | 5009799 | | 1/1993 |
| JP | 10130878 | | 5/1998 |
| WO | WO 98/40539 | | 9/1998 |
| WO | PCT/EP99/05443 | | 3/1999 |
| WO | PCT/EP99/05443 | | 4/1999 |

OTHER PUBLICATIONS

Makoto Nonomura, Cyanide Formation in an Alkaline Noncyanide Zinc Plating Bath, Jun. 1994.

A. V. Ryabchenkov, Electrodeposition of Zinc-Nickel Alloys from Electrolytes Containing Polyethylenepolyamine as a Complexing Agent, Nov. 16, 1972.

A. Moebius, Maintenance of Electroplating and Pickling Baths—The Key for the Minimization of Waste, Jan. 1993.

Wayne Roberts, Inert Anode for Chloride Zinc Plating, Jan. 1997.

* cited by examiner

METHODS OF PLATING ZINC-CONTAINING COATINGS UNDER ALKALINE CONDITIONS

CROSS-REFERENCE TO RELATED APPLICATIONS

This is a continuation of U.S. application Ser. No. 10/618,352, filed Jul. 11, 2003, now abandoned, which is a divisional of U.S. application Ser. No. 09/744,706, filed Jan. 30, 2010, now U.S. Pat. No. 6,602,394, which is a national stage of International Patent Application No. PCT/EP99/05443, filed Jul. 29, 1999.

BACKGROUND OF THE INVENTION

The invention relates to an electroplating bath for plating zinc-nickel coatings, having an anode, a cathode and an alkaline electrolyte.

It is known to coat electrically conductive materials with zinc-nickel alloys in order to improve their resistance to corrosion. To do this, it is customary to use an acidic electrolyte bath, for example, with a sulfate, chloride, fluoropromate [sic] or sulfamate electrolyte. In these processes, it is very difficult and, in practice, generally impossible, in terms of control technology, to achieve a uniform thickness of the zinc-nickel coating on the material to be coated.

For this reason, the alkaline zinc-nickel electroplating baths which are disclosed in German Patent 37 12 511 have recently been used, having, for example, the following composition:

11.3 g/l ZnO
4.1 g/l $NiSO_4*6H_2O$
120 g/l NaOH
5.1 g/l polyethyleneimine.

The amines contained in the electroplating bath serve as complex formers for the nickel ions, which are otherwise insoluble in the alkaline medium. The composition of the baths varies depending on the manufacturer.

The electroplating baths are usually operated with insoluble nickel anodes. The zinc concentration is kept constant by the addition of zinc and the nickel concentration is kept constant by the addition of a nickel solution, for example, a nickel sulfate solution. However, after they have been operating for a few hours, the color of these baths changes from what was originally blue-violet to brown. After a few days or weeks, this discoloration becomes more intense and it is possible to detect a separation of the bath into two phases, the upper phase being dark brown. This phase causes considerable disruption to the coating of the workpieces, such as, for example, nonuniform layer thickness or blistering. It is therefore imperative for the bath to be continuously cleaned, i.e., for this layer to be skimmed off continuously. However, this is time-consuming and expensive.

Furthermore, after a few weeks of operation it is possible to detect cyanide in the baths. Cyanide pollution requires regular cleaning of the bath and special wastewater treatment, which has a considerable effect on the operating costs of the bath. This applies all the more so if the wastewater has a very high concentration of organics and, with a COD value of approximately 15,1000 to 20,000 mg/l, makes cyanide detoxification more difficult. It is then only possible to adhere to statutory wastewater parameters (nickel 0.5 ppm and zinc 2 ppm) by the extensive addition of chemicals.

The formation of the second phase is attributable to a reaction of the amines, which in alkaline solution are converted at the nickel anodes to form nitrites (including to form cyanide). Moreover, on account of the amines being broken down, fresh complex former has to be continuously added to the bath, which increases the costs of the process.

Anodes other than nickel anodes cannot be used, since they dissolve in the alkaline electrolyte, which also has adverse effects on the quality of the coating.

BRIEF SUMMARY OF THE INVENTION

In view of this background, the invention is based on the problem of providing an alkaline zinc-nickel electroplating bath which provides high-quality zinc-nickel coatings at low cost.

To solve this problem, the invention proposes separating the anode from the alkaline electrolyte by an ion exchange membrane.

This separation prevents the amines from reacting at the nickel anode, with the result that there are no undesirable secondary reactions which cause waste disposal problems or lead to a second phase of reaction products being deposited on the bath and adversely affect the quality of the zinc-nickel coating. The invention obviates the need for this layer to be skimmed off at high cost and to renew the bath. Furthermore, there is a considerable improvement in the quality of the coating.

The use of a cation exchange membrane made from a perfluorinated polymer has proven particularly advantageous, since such membranes have a negligible electrical resistance but a high chemical and mechanical resistance.

Furthermore, the cyanide poisoning of the wastewater no longer takes place, thus considerably simplifying the entire wastewater treatment. Furthermore, there is no need to top up the complex former in the electrolyte, since it is no longer broken down and its concentration in the bath remains approximately constant. As a result, the cost of the process becomes considerably less expensive.

In the solution according to the invention, the zinc-nickel bath functions as catholyte. The anolyte used may, for example, be sulfuric acid or phosphoric acid. In the electroplating cell according to the invention, customary anodes, such as, for example, platinum-coated titanium anodes, are suitable as anode material, since they are no longer exposed to the basic zinc-nickel bath.

The present invention is explained in more detail with reference to the exemplary embodiment illustrated in the drawing, in which:

DETAILED DESCRIPTION OF THE INVENTION

Figure 1:
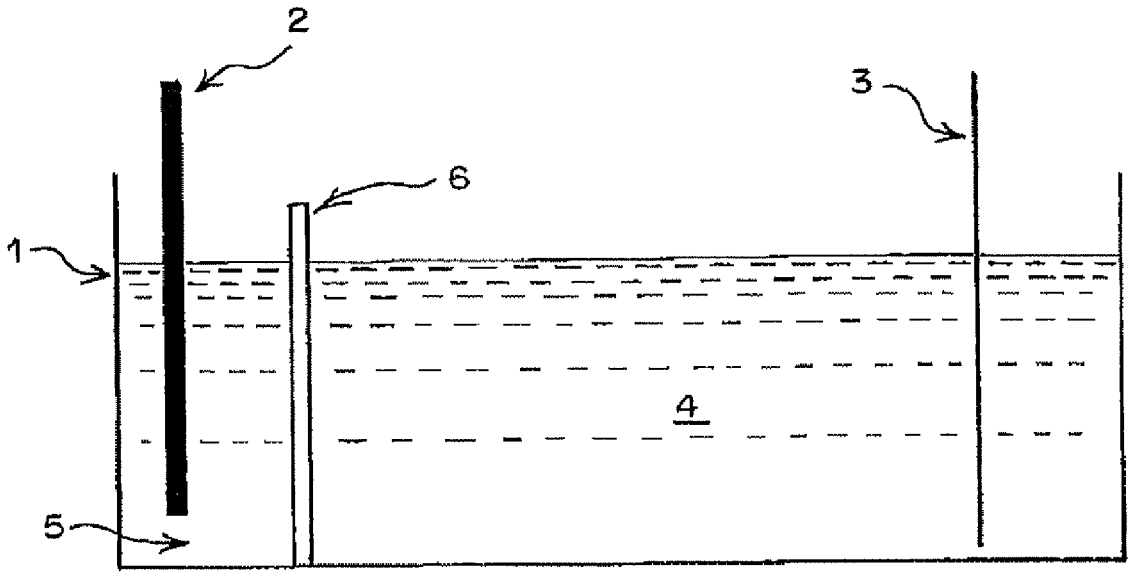
FIG. 1 shows the diagrammatic structure of an electroplating bath according to the invention.

FIG. 1 shows an electroplating cell 1 which has an anode 2 and a cathode 3, which is the workpiece to be coated. The catholyte 4 surrounding the cathode is alkaline and consists of a zinc-nickel electroplating bath of known composition, in which amines are added as complex formers for the nickel ions. The anolyte 5 surrounding the anode 2 may, for example, consist of sulfuric acid or phosphoric acid. Anolyte 5 and catholyte 4 are separated from one another by a perfluorinated cation exchange membrane 6. This membrane 6 allows unimpeded flux of current through the bath but prevents the catholyte 4, in particular the amines contained therein, from coming into contact with the anode 2, thus preventing the reactions which were extensively described in the introduction to the description, including the adverse effects of these reactions.

The invention claimed is:

1. A method for plating zinc-containing coatings under alkaline conditions from an electroplating bath comprising:

providing an electroplating cell having an anode and a cathode;

separating said anode from said cathode by an ion-exchange membrane to provide an anode compartment and a cathode compartment;

introducing an alkaline electrolyte with metal ions for a zinc-nickel coating into said cathode compartment; and introducing a complex former for nickel into said electrolyte of said electroplating bath wherein said complex former comprises an amine.

2. The method of claim 1 comprising introducing an anolyte into said anode compartment, wherein said anolyte is selected from the group consisting of sulfuric acid, phosphoric acid, methanesulfonic acid, amidosulfonic acid and/or phosphonic acid.

3. A method of inhibiting cyanide formation in an alkaline electroplating bath comprising an anode and a cathode with an alkaline electrolyte with metal ions for a zinc-metal coating comprising:

introducing an alkaline electrolyte with metal ions for a zinc-containing coating;

introducing a complex former into said alkaline electrolyte, said complexing agent comprising an amine; and at least substantially preventing contact between said anode and said amine by separating said anode from said cathode member to provide an anode compartment and a cathode compartment.

4. The method of claim 3 comprising at least substantially preventing contact between said anode and said amine by separating said anode from said cathode with a selectively permeable membrane capable of allowing at least substantially unimpeded flux of current therethrough, but being at least substantially impermeable to said amine.

5. The method of claim 4 wherein said membrane comprises an ion-exchange membrane.

6. The method of claim 4 wherein said membrane comprises a polymeric material having a low electrical resistance and being at least substantially impermeable to amines.

7. The method of claim 4 wherein said membrane comprises a perfluorinated polymer.

* * * * *